US008814608B2

(12) United States Patent
Song et al.

(10) Patent No.: US 8,814,608 B2
(45) Date of Patent: Aug. 26, 2014

(54) PLUG AND POWER CONNECTOR

(71) Applicants: Huawei Technologies Co., Ltd., Shenzhen (CN); China Aviation Optical-Electrical Technology Co., Ltd., Luoyang (CN)

(72) Inventors: Min Song, Shenzhen (CN); Tengfang Xiong, Shenzhen (CN); Baoliang Sun, Shenzhen (CN); Jianguo Wang, Chengdu (CN); Yong Yao, Luoyang (CN)

(73) Assignees: Huawei Technologies Co., Ltd., Shenzhen (CN); China Aviation Optical-Electrical Technology Co., Ltd., Luoyang (CN)

( * ) Notice: Subject to any disclaimer, the term of this patent is extended or adjusted under 35 U.S.C. 154(b) by 0 days.

(21) Appl. No.: 14/057,696

(22) Filed: Oct. 18, 2013

(65) Prior Publication Data

US 2014/0045359 A1 Feb. 13, 2014

Related U.S. Application Data

(63) Continuation of application No. 13/919,520, filed on Jun. 17, 2013, which is a continuation of application No. PCT/CN2011/079755, filed on Sep. 16, 2011.

(30) Foreign Application Priority Data

Dec. 17, 2010 (CN) ..... 2010 1 0605184

(51) Int. Cl.
*H01R 4/36* (2006.01)

(52) U.S. Cl.
USPC ..... 439/814; 439/108; 439/348

(58) Field of Classification Search
USPC ..... 439/607.41–607.52, 98, 108, 469, 439/810–814, 348
See application file for complete search history.

(56) References Cited

U.S. PATENT DOCUMENTS 3,281,755 A * 10/1966 Trager ..... 439/320
3,390,371 A * 6/1968 Kramer ..... 439/472

(Continued)

FOREIGN PATENT DOCUMENTS

CN 2078933 U 6/1991
CN 201294308 Y 8/2009

(Continued)

OTHER PUBLICATIONS

International Search Report dated Dec. 15, 2011 in connection with International Patent Application No. PCT/CN2011/079755.

(Continued)

*Primary Examiner* — Ross Gushi

(57) ABSTRACT

The embodiments of the present invention provide a plug and a power connector. The plug is applied in a power connector connected between a power supply device and a radio frequency module. The plug includes a jack and a crimping component set at a tail end of the jack, and the crimping component is configured to connect a power cable introduced from the power supply device to the jack in a manner of fixing. A power connector that includes the plug is further provided. By using the technical solutions according to the embodiments, easy on-site installation of the power connector that includes the plug during use may be ensured.

14 Claims, 5 Drawing Sheets

(56) References Cited

U.S. PATENT DOCUMENTS

| | | | | | |
|---|---|---|---|---|---|
| 3,402,382 | A | * | 9/1968 | De Tar | 439/469 |
| 3,571,781 | A | * | 3/1971 | Gartland et al. | 439/465 |
| 3,605,059 | A | * | 9/1971 | Lipinski et al. | 439/106 |
| 3,675,184 | A | * | 7/1972 | Vetter | 439/462 |
| 3,816,641 | A | * | 6/1974 | Iversen | 174/76 |
| 3,856,376 | A | * | 12/1974 | Poliak et al. | 439/465 |
| 3,865,461 | A | * | 2/1975 | Ludwig | 439/463 |
| 4,053,198 | A | * | 10/1977 | Doyle et al. | 439/462 |
| 4,191,443 | A | * | 3/1980 | Doyle | 439/462 |
| 4,213,667 | A | * | 7/1980 | Wittes | 439/469 |
| 4,634,211 | A | * | 1/1987 | Poliak et al. | 439/106 |
| 4,836,805 | A | * | 6/1989 | Poliak et al. | 439/657 |
| 5,021,006 | A | * | 6/1991 | Fargeaud et al. | 439/469 |
| 5,135,404 | A | * | 8/1992 | Clark | 439/106 |
| 5,167,527 | A | * | 12/1992 | Clark | 439/469 |
| 5,439,388 | A | * | 8/1995 | Weiss et al. | 439/417 |
| 5,449,302 | A | * | 9/1995 | Yarbrough et al. | 439/680 |
| 5,591,046 | A | * | 1/1997 | Klein et al. | 439/467 |
| 5,645,447 | A | * | 7/1997 | Sandor | 439/467 |
| 5,782,653 | A | * | 7/1998 | Sandor | 439/467 |
| 5,885,099 | A | * | 3/1999 | Sandor | 439/467 |
| 5,932,841 | A | | 8/1999 | Matsumoto et al. | |
| 5,934,931 | A | * | 8/1999 | Castaldo | 439/467 |
| 5,975,941 | A | * | 11/1999 | Castaldo | 439/469 |
| 6,010,348 | A | * | 1/2000 | Alden | 439/274 |
| 6,071,145 | A | * | 6/2000 | Toly | 439/485 |
| 6,126,478 | A | * | 10/2000 | Presson et al. | 439/467 |
| 6,409,532 | B2 | * | 6/2002 | Payson et al. | 439/320 |
| 6,582,248 | B2 | * | 6/2003 | Bachman | 439/462 |
| 6,595,791 | B2 | * | 7/2003 | Below et al. | 439/271 |
| 6,695,639 | B2 | * | 2/2004 | Castaldo et al. | 439/467 |
| 6,739,900 | B2 | * | 5/2004 | Mortun et al. | 439/469 |
| 6,805,578 | B2 | * | 10/2004 | Chiou et al. | 439/469 |
| 6,817,902 | B2 | * | 11/2004 | Bernardi et al. | 439/676 |
| 6,902,423 | B2 | * | 6/2005 | Castaldo et al. | 439/467 |
| 6,935,886 | B2 | * | 8/2005 | Hoch et al. | 439/462 |
| 7,097,486 | B2 | * | 8/2006 | Parsons | 439/291 |
| 7,101,218 | B2 | * | 9/2006 | Castaldo et al. | 439/467 |
| 7,214,094 | B2 | * | 5/2007 | Kaminski et al. | 439/550 |
| 7,303,418 | B2 | * | 12/2007 | O'Connor | 439/277 |
| 7,367,848 | B2 | * | 5/2008 | John | 439/676 |
| 7,798,869 | B1 | * | 9/2010 | Konopacki et al. | 439/812 |
| 7,841,881 | B2 | * | 11/2010 | Hsu et al. | 439/277 |
| 7,938,674 | B2 | * | 5/2011 | Lindkamp et al. | 439/462 |
| 7,976,352 | B2 | * | 7/2011 | Nishimura | 439/814 |
| 7,988,476 | B2 | * | 8/2011 | Billman et al. | 439/271 |
| 8,348,706 | B2 | * | 1/2013 | Yu et al. | 439/814 |
| 2003/0148652 | A1 | * | 8/2003 | Bernardi et al. | 439/462 |
| 2004/0180569 | A1 | * | 9/2004 | Chiou et al. | 439/469 |
| 2010/0035448 | A1 | | 2/2010 | Nishimura | |
| 2010/0261367 | A1 | * | 10/2010 | Billman et al. | 439/271 |
| 2011/0136369 | A1 | * | 6/2011 | Dang | 439/352 |

FOREIGN PATENT DOCUMENTS

| | | | |
|---|---|---|---|
| CN | 201490441 | U | 5/2010 |
| CN | 201584588 | U | 9/2010 |
| CN | 201608394 | U | 10/2010 |
| CN | 102163776 | A | 8/2011 |
| DE | 19751786 | A1 | 5/1999 |
| DE | 202009004907 | U1 | 8/2009 |
| EP | 1 263 089 | A1 | 12/2002 |
| EP | 2 546 934 | A1 | 1/2013 |

OTHER PUBLICATIONS

Translation of Office Action dated Jul. 16, 2012 in connection with Chinese Patent Application No. 201010605184.6.

Translation of Written Opinion of the International Searching Authority dated Dec. 15, 2011 in connection with International Patent Application No. PCT/CN2011/079755.

Translation of Second Office Action dated Dec. 26, 2012 in connection with Chinese Application No. 201010605184.6.

* cited by examiner

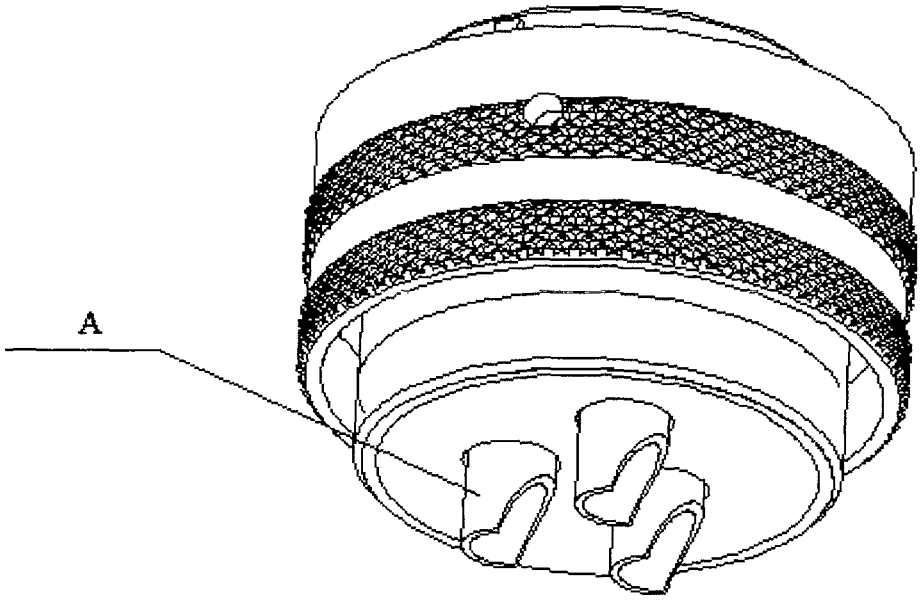
FIG. 1（PRIOR ART）
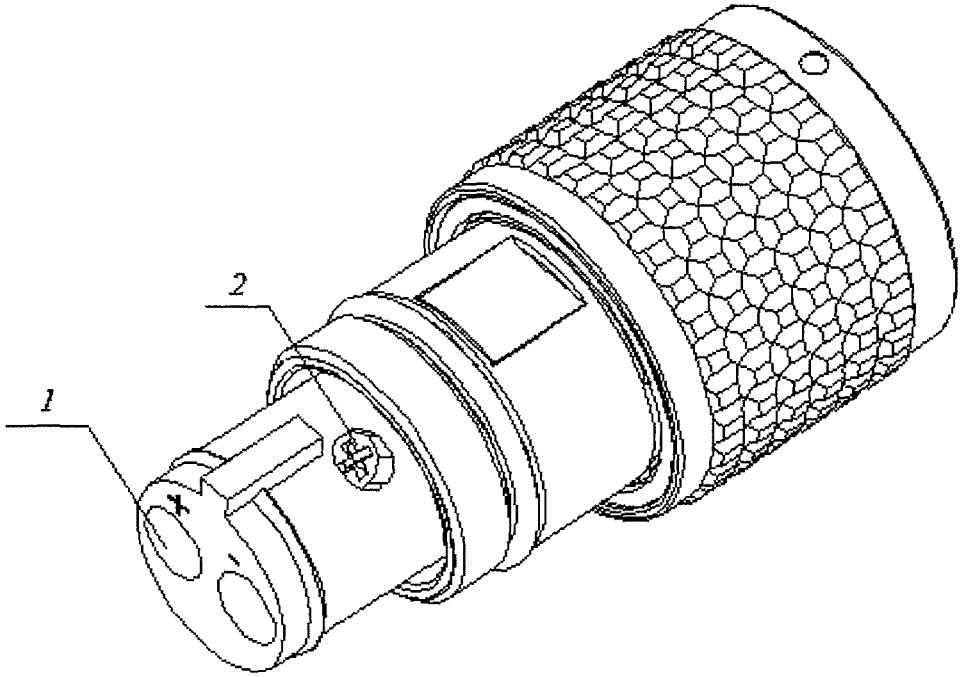
FIG. 2

PLUG AND POWER CONNECTOR

CROSS-REFERENCE TO RELATED APPLICATIONS

This application is a continuation of U.S. patent application Ser. No. 13/919,520, filed on Jun. 17, 2013, which is a continuation of International Application No. PCT/CN2011/079755, filed on Sep. 16, 2011, which claims priority to Chinese Patent Application No. 201010605184.6, filed on Dec. 17, 2010, all of which are hereby incorporated by reference in their entireties.

TECHNICAL FIELD

The present invention relates to the technical field of radio communications devices, and in particular, to a plug of a power connector connected between a power supply device and a radio frequency module, and a power connector that includes this plug.

BACKGROUND

A radio frequency module is a very important component of a radio communications device. For outdoor use, the radio frequency module must be connected to a power supply device through a power connector.

A power connector in the conventional art includes two parts: plug and socket. FIG. 1 is a schematic structural diagram of a plug of a power connector in the conventional art. As shown in FIG. 1, the plug according to this embodiment includes a jack (not illustrated in the figure) and a solder cup A set at a tail end of the jack. This jack may be specifically in the plug in the figure and connected to solder cup A, and the jack is an electrically conductive metal tube. When the plug is connected to the socket, the jack in the plug may be electrically connected to a pin set in the socket. The other end of the socket is connected to a radio frequency module. During use on site, a power cable introduced from a power supply device is soldered, by using a soldering torch, to the solder cup A set on the plug, and then the plug is connected to the socket, thereby implementing electrical connection between the radio frequency module and the power supply device.

During use of the power connector in the conventional art, on-site soldering must be performed to solder the power cable introduced from the power supply device to the solder cup A set on the plug. However, as the radio frequency module is generally used outdoors, no power supply for soldering can be provided to the soldering torch in a harsh environment. Therefore, using the power connector in the prior art and the plug used thereon is inconvenient.

SUMMARY

Embodiments of the present invention provide a plug and a power connector, so as to eliminate the defect of inconvenient use of the power connector and the plug used thereon in the conventional art, and provide a plug and a power connector that are easy to install.

An embodiment of the present invention provides a plug that is applied in a power connector connected between a power supply device and a radio frequency module. The plug includes a jack and a crimping component set at a tail end of the jack, and the crimping component is configured to connect a power cable introduced from the power supply device to the jack in a manner of fixing.

An embodiment of the present invention further provides a power connector that is configured to connect a power supply device and a radio frequency module. The power connector includes a plug and a socket, where the plug and the socket are connected. The plug includes a jack and a crimping component set at a tail end of the jack, and the crimping component is configured to connect a power cable introduced from the power supply device to the jack in a manner of fixing.

According to the plug and power connector in the embodiments of the present invention, a crimping component is set at the tail end of the jack in the plug so as to connect a power cable introduced from a power supply device to the jack in a manner of fixing. In this manner, during on-site installation, only the crimping component is required to connect the power cable introduced from the power supply device to the jack in a manner of fixing. No soldering is required anymore, facilitating installation and use.

BRIEF DESCRIPTION OF THE DRAWINGS

To illustrate the technical solutions in the embodiments of the present invention or in the prior art more clearly, the following briefly describes the accompanying drawings required for describing the embodiments or the prior art. Apparently, the accompanying drawings in the following description show some embodiments of the present invention, and persons of ordinary skill in the art can derive other drawings from these accompanying drawings without creative efforts.

FIG. 1 is a schematic structural diagram of a plug of a power connector in the prior art;

FIG. 2 is a schematic structural diagram of a plug according to a first embodiment of the present invention;

DETAILED DESCRIPTION

Figure 3:
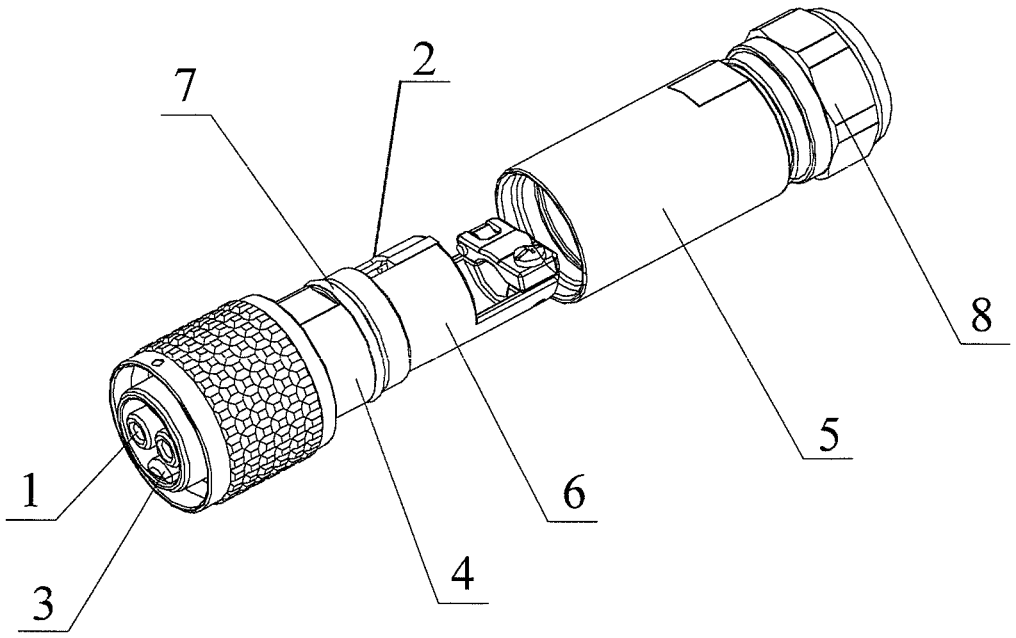
FIG. 3 is a schematic structural diagram of a plug according to a second embodiment of the present invention.

To make the objectives, technical solutions, and advantages of the present invention more comprehensible, the following clearly and completely describes the technical solutions according to the embodiments of the present invention with reference to the accompanying drawings in the embodiments of the present invention. Apparently, the embodiments in the following description are merely a part rather than all of the embodiments of the present invention. All other embodiments obtained by persons of ordinary skill in the art based on the embodiments of the present invention without creative efforts shall fall within the protection scope of the present invention.

FIG. 2 is a schematic structural diagram of a plug according to a first embodiment of the present invention. The plug according to this embodiment is applied on a power connector connected between a power supply device and a radio frequency module. As shown in FIG. 2, the plug according to this embodiment includes a jack 1 and a crimping component 2 set at a tail end of the jack 1; the crimping component 2 is configured to connect a power cable introduced from the power supply device to the jack 1 in a manner of fixing; the jack 1 is made of electrically conductive metal.

Specifically, during use, after the power cable is introduced from the power supply device, the power cable is connected to the jack 1 in a manner of fixing by using the crimping component 2. The crimping component 2 may specifically be a crimping screw that is set on a side wall of the jack 1 and that may revolve. The power cable introduced from the power supply device is pressed and fixed in the jack 1 by revolving the screw. The crimping component 2 may also adopt other structures as long as the power cable introduced from the power supply device can be connected to the jack 1 in a manner of fixing. A front end of the jack 1 according to this embodiment is configured to be fit-connected to a pin on the socket. Therefore, the front end of the jack 1 is certainly hollow. The part near a port at the tail end may also be set hollow so as to facilitate insertion of the power cable. The rest part may be set solid or hollow according to actual requirements.

According to the plug in this embodiment, a crimping component is set at the tail end of the jack on the plug so as to connect a power cable introduced from a power supply device to the jack in a manner of fixing. In this manner, during on-site installation, only a crimping component is required to connect the power cable introduced from the power supply device to the jack in a manner of fixing. No soldering is required anymore, facilitating installation during use.

It should be noted that the number of the jack 1 in the embodiment may specifically be two. One is configured to connect a positive pole of the power cable. The other is configured to connect a negative pole of the power cable. The corresponding crimping components 2 may specifically be two crimping screws, where one is set in the jack 1 that connects the positive pole of the power cable and the other is set in the jack 1 that connects the negative pole of the power cable. In an actual application, the number of the jack 1 may also be three, so as to provide a jack that connects a ground line when AC power is connected.

FIG. 3 is a schematic structural diagram of a plug according to a second embodiment of the present invention. On the basis of the plug structure shown in the first embodiment, as shown in FIG. 3, in this embodiment, an insulation component 3 is set on an external part of the jack 1. As the jack 1 is configured to conduct electricity, to protect the electrically conductive jack 1, the insulation component 3 may be set on the external part of the jack 1. As shown in FIG. 3, the insulation component 3 may be an insulation layer that surrounds the external part of the two jacks 1. One end of the jack 1 is connected to the power cable, and the other end is connected to the pin on the socket. A first shell 4 of a metal material is set on an external part of the insulation component 3 and in a direction approaching a side of connection with the socket. A sleeve 5 of a metal material is set on the external part of the insulation component 3 and in a direction departing from the side of connection with the socket. That is, the sleeve 5 is set on the external part of the insulation component 3 and in the direction approaching the side of connection with the power cable introduced from the power supply device. The first shell 4 and the sleeve 5 are connected through a first thread. In other words, the first shell 4 and the sleeve 5 are connected by using a screw thread. Specifically, an outward-protruding screw thread may be set on an outer surface of an end, connected to the sleeve 5, of the first shell 4, and an embedded screw thread may be set on an inner surface of an end, connected to the first shell 4, the sleeve 5. In this manner, the diameter of the sleeve 5 must be larger than the diameter of the first shell 4 so that the first shell 4 and the sleeve 5 is fit-connected exactly through the first thread. It should be noted that the first shell 4 and the jack 1 may be set to be fixed relative to each other. The sleeve 5 may move relative to the jack 1. When the first thread that connects the first shell 4 and the sleeve 5 is opened, the sleeve 5 is capable of moving relative to the first shell 4 in an opposite direction, so as to expose the crimping component 2 set at the tail end of the jack 1.

In this manner, during use, the first thread is opened, and the sleeve 5 is moved to expose the crimping component 2. Then the power cable introduced from the power supply device is connected to the jack 1 in a manner of fixing by using the crimping component 2. Then the first shell 4 and the sleeve 5 are connected by using the first thread so as to exactly surround the jack 1 therein.

As the plug in this embodiment is used outdoors, to effectively protect against lightning, as shown in FIG. 3, in this embodiment, a shielding component 6 of a metal material may further be set on an outer surface of the insulation component 3 in the range surrounded by the sleeve 5. This shielding component 6 is connected to a shielding layer of the power cable introduced from the power supply device. The shielding component 6 is further connected to the first shell 4. In addition, when the sleeve 5 is connected to the first shell 4, the shielding component 6 may also be surrounded therein.

Figure 4:
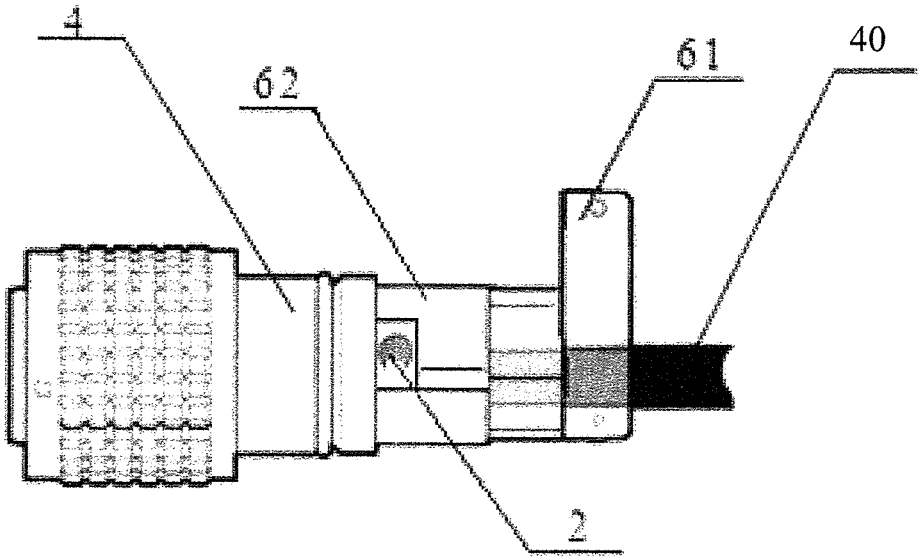
FIG. 4 is a schematic structural diagram of a shielding component according to the second embodiment of the present invention.

FIG. 4 is a schematic structural diagram of a shielding component according to the second embodiment of the present invention. As shown in FIG. 4, as the shielding component 6 needs to be connected to the shielding layer of the power cable, preferably, the shielding component 6 is set at the tail end of the insulation component 3 to facilitate connection with the shielding layer of the power cable. For example, a clip-shaped shielding clip 61 of a metal material may be set on the shielding component 6 to facilitate connection with the shielding layer of the power cable 40. As the shielding component 6 further needs to be connected to the first shell 4, a metal layer 62 as a part of the shielding component 6 may be set on the external part of the insulation component 3. The metal layer 62 is connected to the first shell 4. In this manner, the metal layer 62 and the metal shielding clip 61 collectively form the shielding component 6.

During use, the shielding component 6 is connected to the first shell 4. When the plug is connected to the socket, the first shell 4 is connected to a second shell of the socket, and the second shell of the socket is further connected to a shell of the radio frequency module, and grounded. In this manner, when lightning occurs, an instantaneous induced current is large, the shielding component 6 may lead the induced current on the shielding layer of the power cable through the first shell 4, the second shell on the socket, and the shell of the radio frequency module, and then ground and release the induced current. As such, lightning protection is implemented.

As the plug in this embodiment is used outdoors, the plug needs further to be effectively waterproof. As shown in FIG. 3, in the plug in this embodiment, a waterproof O-shaped ring 7 that is made of rubber needs to be set between the first shell 4 and the sleeve 5 for sleeving. As the first shell 4 and the sleeve 5 are merely of hard metal materials, rain water may leak into the jack 1 through a gap between the first shell 4 and the sleeve 5 in rainy days, which is very dangerous. Here, the waterproof O-shaped ring 7 is set at the junction between the first shell 4 and the sleeve 5. When the first shell 4 is connected to the sleeve 5, the waterproof O-shaped ring 7 is tightly pressed in the sleeve 5. In this manner, when the first shell 4 is connected to the sleeve 5, the waterproof O-shaped ring 7 may fill in the gap at the junction between the first shell 4 and the sleeve 5 that are connected, effectively preventing water.

Figure 5:
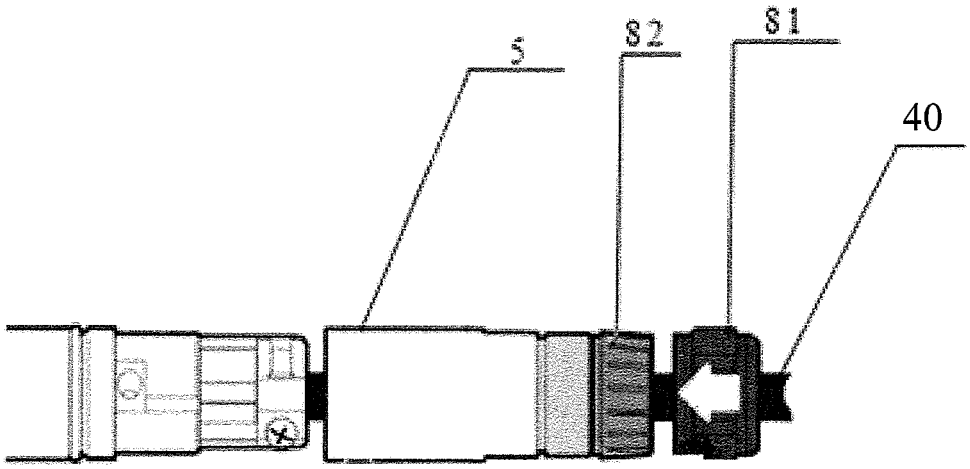
FIG. 5 is a schematic structural diagram of a waterproof component according to the second embodiment of the present invention.

Meanwhile, a waterproof component 8 is further set at the tail end of the sleeve 5. The power cable introduced from the power supply device enters the plug through the tail end of the sleeve 5. The waterproof component 8 prevents rain water from entering into the jack 1 at the position where the power cable enters the plug. FIG. 5 is a schematic structural diagram of a waterproof component according to the second embodiment of the present invention. As shown in FIG. 5, the waterproof component 8 may include a nut 81 and a waterproof sleeving member 82. The nut 81 and the waterproof sleeving member 82 are each provided with a hole to allow the power cable 40 introduced from the power supply device to pass through. The nut 81 is connected to the sleeve 5 through a second thread. Specifically, an outward-protruding screw thread fitting an embedded screw thread of the nut 81 may be set on the tail end of the sleeve 5. The nut 81 is fit-connected to the sleeve 5 through the screw threads. As the connection between the nut 81 and the sleeve 5 is not tight, rain water may leak especially in rainy days. To effectively achieve waterproofing, a waterproof sleeving member 82 may be set in the nut 81 when the nut 81 is connected to the sleeve 5. In this manner, when the nut 81 is connected to the sleeve 5, the waterproof sleeving member 82 may fill in the gap at the junction between the nut 81 and the sleeve 5 and the gap between the power connector and the power cable, effectively achieving a waterproof effect.

The plug according to the embodiment facilitates on-site installation during use, and is also capable of effectively effects of lightning protection and waterproofing.

By using the plug in the embodiment, a socket in the conventional art can be connected. For example, screw threads fitting each other may be set between the second shell of the socket and the first shell of the plug. In this manner, assembly of the power connector is implemented.

Figure 6:
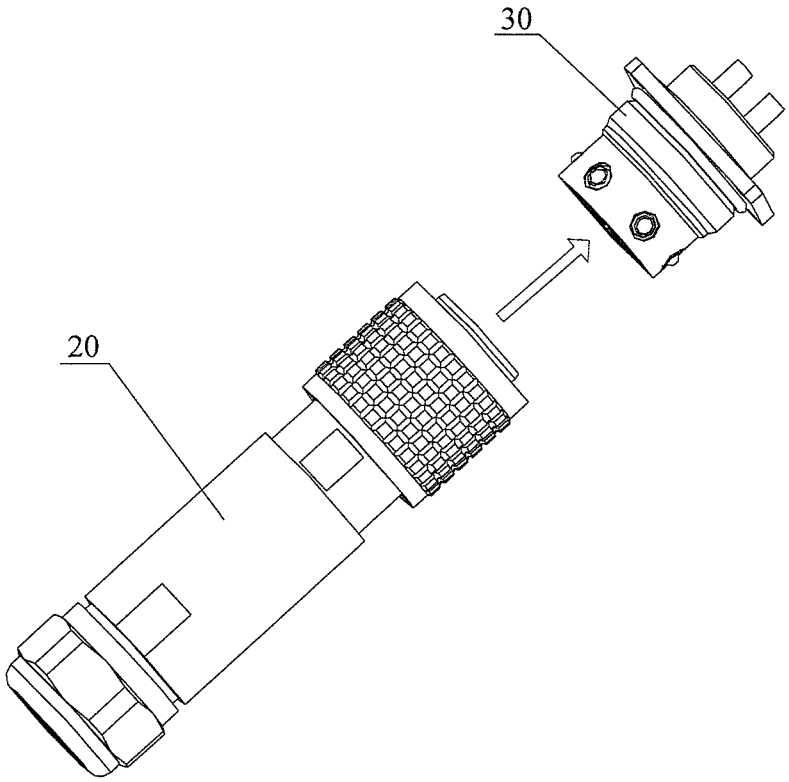
FIG. 6 is an overall structural diagram of a power connector according to a third embodiment of the present invention.

FIG. 6 is an overall structural diagram of a power connector according to a third embodiment of the present invention. The power connector according to this embodiment is configured to connect a power supply device and a radio frequency module. As shown in FIG. 6, the power connector in this embodiment includes a plug 20 and a socket 30, where the plug 20 and the socket 30 are connected. The plug 20 and the socket 30 of the power connector in this embodiment are described blow in detail.

Figure 7:
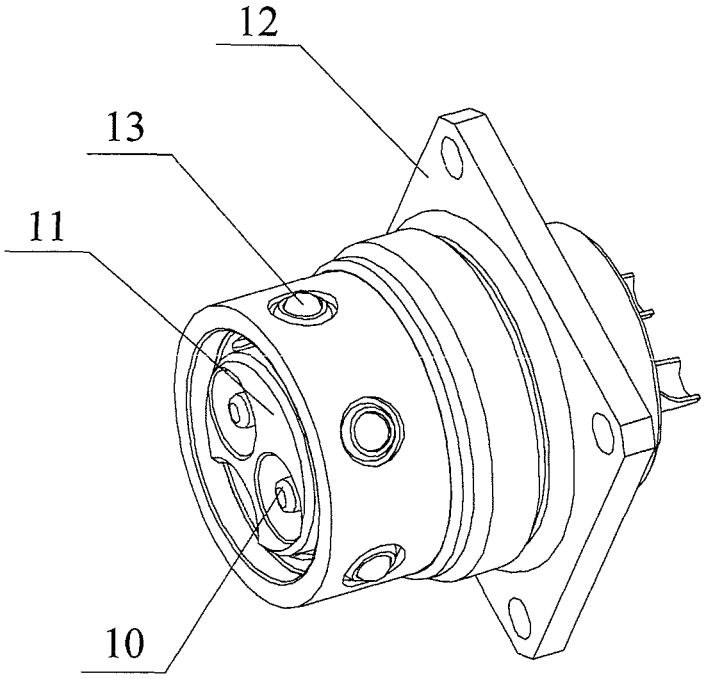
FIG. 7 is a schematic structural diagram of a socket on the power connector according to the third embodiment of the present invention.

FIG. 7 is a schematic structural diagram of the socket in the power connector according to the third embodiment of the present invention. As shown in FIG. 7, the socket in this embodiment may include a pin 10 that is connected to a corresponding jack 1 in the plug. The number of the pins 10 corresponds to the number of the jacks 1. The external part of the pin 10 is also surrounded by an insulation layer 11 to isolate the pin 10. The socket further includes a second shell 12 of a metal material. The second shell 12 surrounds the pin 10 therein and the insulation layer 11 that isolates the pin 10. In this embodiment, multiple locking steel balls 13 are set on the second shell 12 in the socket. The locking steel balls 13 are located on a same section that is perpendicular to a side wall of the second shell 12, and preferably evenly distributed on the section.

Figure 8:
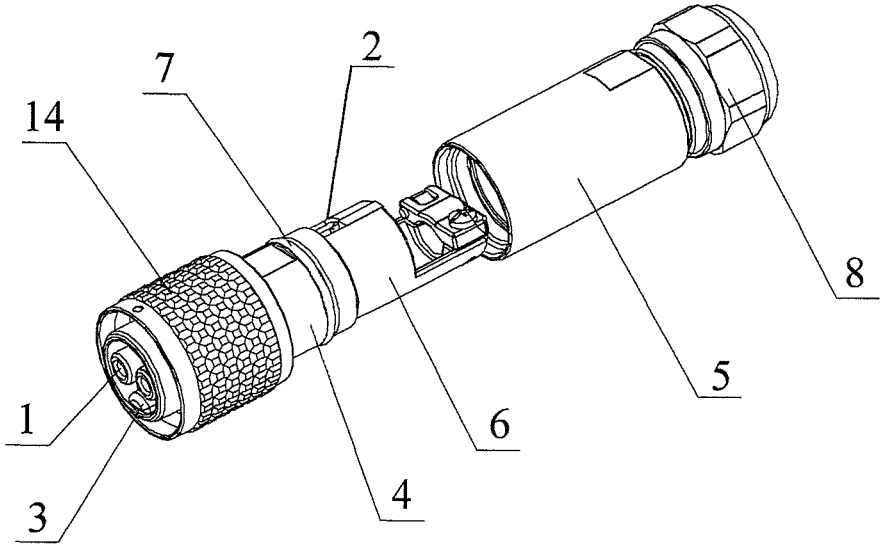
FIG. 8 is a schematic structural diagram of a plug on the power connector according to the third embodiment of the present invention.

FIG. 8 is a schematic structural diagram of the plug in the power connector according to the third embodiment of the present invention. As shown in FIG. 8, the plug in the power connector in this embodiment may adopt the structure of the plug shown in the second embodiment, and further a locking sleeve 14 may be set on the external part of the first shell 4, and an annular groove (not illustrated in the figure) may be set on the outer surface of the first shell 4. A section where the annular groove is located is perpendicular to the side wall of the first shell 4. When the jack 1 is connected to the pin 10, the locking sleeve 14 on the first shell 4 is pressed against the multiple locking steel balls 13 on the second shell 12 so that the multiple locking steel balls 13 are engaged with the annular groove.

Figure 9:
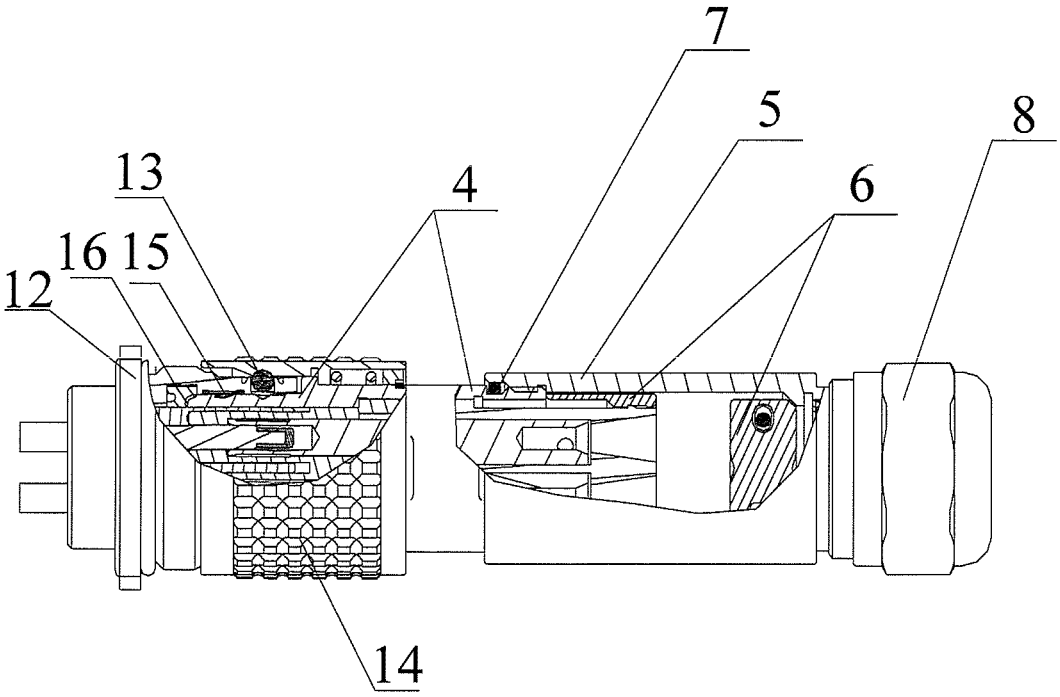
FIG. 9 is a schematic structural diagram of the power connector according to the third embodiment of the present invention.

FIG. 9 is a schematic structural diagram of the power connector according to the third embodiment of the present invention. Specifically, FIG. 9 is a schematic structural diagram when the socket shown in FIG. 7 is connected to the plug shown in FIG. 8. As shown in FIG. 9, to avoid loose connection between the first shell 4 and the second shell 12, which leads to a case where an induced current cannot be released in time, an elastic piece 15 may further be set in the second shell 12. When the jack 1 is connected to the pin 10, the first shell 4 is tightly pressed against the elastic piece 15, and the elastic piece 15 is set on the second shell 12. In this manner, desired contact between the first shell 4 and the second shell 12 may be ensured, thereby ensuring that the shielding component 6 can finally release the induced current through the first shell 4, second shell 12, and the shell of the radio frequency module when the power connector suffers a lightning strike.

It should be noted that, as shown in FIG. 9, the socket in the power connector in this embodiment may further be provided with a waterproof rubber gasket 16. The waterproof rubber gasket 16 is set on the second shell 12, and may specifically be of a ring shape. When the second shell 12 is connected to the first shell 4, the waterproof rubber gasket 16 is pressed tightly by an end surface, in the second shell 12, of the first shell 4, thereby blocking the gap at the junction between the second shell 12 and the first shell 4 and preventing rain water from entering into the power connector in rainy days. It should be noted that in this embodiment, except the waterproof O-shaped ring 7, waterproof sleeving member 82, and waterproof rubber gasket 16 that adopt non-metal materials, all other components are made of electrically conductive metal.

The power connector according to the embodiment facilitates on-site installation during use, and is also capable of effective lightning protection and waterproofing.

Finally, it should be noted that the foregoing embodiments of the present invention are intended for describing the technical solutions of the present invention other than limiting the present invention. Although the present invention is described in detail with reference to the foregoing embodiments, persons of ordinary skill in the art should understand that they can still make modifications to the technical solutions described in the foregoing embodiments, or make equivalent substitutions to some technical features thereof, without departing from the spirit and scope of the technical solutions of the embodiments of the present invention.

What is claimed is:

1. A plug, configured to be applied in a power connector connected between a power supply device and a radio frequency module, wherein the plug comprises a jack and a crimping component set at a tail end of the jack, and the crimping component is configured to connect a power cable introduced from the power supply device to the jack;

wherein an insulation component is set on an external part of the jack; and a first shell of a metal material is set on an external part of the insulation component and in a direction approaching a side of connection with a socket; a sleeve of a metal material is set on the external part of the insulation component and in a direction departing from the side of connection with the socket; the first shell and the sleeve are connected through a first thread; wherein when the first thread is opened, the sleeve is capable of moving relative to the first shell so as to expose the crimping component;

wherein a shielding component of a metal material is set on an outer surface of the insulation component in a range surrounded by the sleeve, the shielding component is configured to connect to a shielding layer of the power cable, and the shielding component is further connected to the first shell.

2. The plug according to claim 1, wherein the crimping component is a crimping screw.

3. The plug according to claim 1, wherein a waterproof component is set at a tail end of the sleeve.

4. The plug according to claim 3, wherein the waterproof component is connected to the sleeve through a second thread; the waterproof component comprises a nut and a waterproof sleeving member set in the nut; and the nut and the waterproof sleeving member are each provided with a hole to allow the power cable to pass through.

5. The plug according to claim 1, wherein the shielding component is set at a tail end of the insulation component.

6. A power connector, configured to connect a power supply device and a radio frequency module; wherein the power connector comprises a plug and a socket, wherein the plug and the socket are connected, wherein the plug comprises a jack and a crimping component set at a tail end of the jack, and the crimping component is configured to connect a power cable introduced from the power supply device to the jack;

wherein an insulation component is set on an external part of the jack; and a first shell of a metal material is set on an external part of the insulation component and in a direction approaching a side of connection with the socket; a sleeve of a metal material is set on the external part of the insulation component and in a direction departing from the side of connection with the socket; the first shell and the sleeve are connected through a first thread; wherein when the first thread is opened, the sleeve is capable of moving relative to the first shell so as to expose the crimping component;

wherein a shielding component of a metal material is set on an outer surface of the insulation component in a range surrounded by the sleeve, the shielding component is configured to connect to a shielding layer of the power cable, and the shielding component is further connected to the first shell.

7. The power connector according to claim 6, wherein the crimping component is a crimping screw.

8. The power connector according to claim 6, wherein a waterproof component is set at a tail end of the sleeve.

9. The power connector according to claim 8, wherein the waterproof component is connected to the sleeve through a second thread; the waterproof component comprises a nut and a waterproof sleeving member set in the nut; and the nut and the waterproof sleeving member are each provided with a hole to allow the power cable to pass through.

10. The plug according to claim 6, wherein the shielding component is set at a tail end of the insulation component.

11. A plug, configured to be applied in a power connector connected between a power supply device and a radio frequency module, wherein the plug comprises a jack and a crimping component set at a tail end of the jack, and the crimping component is configured to connect a power cable introduced from the power supply device to the jack;

wherein an insulation component is set on an external part of the jack; and a first shell of a metal material is set on an external part of the insulation component and in a direction approaching a side of connection with a socket; a sleeve of a metal material is set on the external part of the insulation component and in a direction departing from the side of connection with the socket; the first shell and the sleeve are connected through a first thread; wherein when the first thread is opened, the sleeve is capable of moving relative to the first shell so as to expose the crimping component;

wherein a waterproof O-shaped ring that is made of rubber is set between the first shell and the sleeve.

12. A power connector, configured to connect a power supply device and a radio frequency module; wherein the power connector comprises a plug and a socket, wherein the plug and the socket are connected, wherein the plug comprises a jack and a crimping component set at a tail end of the jack, and the crimping component is configured to connect a power cable introduced from the power supply device to the jack;

wherein an insulation component is set on an external part of the jack; and a first shell of a metal material is set on an external part of the insulation component and in a direction approaching a side of connection with the socket; a sleeve of a metal material is set on the external part of the insulation component and in a direction departing from the side of connection with the socket; the first shell and the sleeve are connected through a first thread; wherein when the first thread is opened, the sleeve is capable of moving relative to the first shell so as to expose the crimping component;

wherein a waterproof O-shaped ring that is made of rubber is set between the first shell and the sleeve.

13. A power connector, configured to connect a power supply device and a radio frequency module; wherein the power connector comprises a plug and a socket, wherein the plug and the socket are connected, wherein the plug comprises a jack and a crimping component set at a tail end of the jack, and the crimping component is configured to connect a power cable introduced from the power supply device to the jack;

wherein an insulation component is set on an external part of the jack;

a first shell of a metal material is set on an external part of the insulation component and in a direction approaching a side of connection with the socket; a sleeve of a metal material is set on the external part of the insulation component and in a direction departing from the side of connection with the socket; the first shell and the sleeve are connected through a first thread; wherein when the first thread is opened, the sleeve is capable of moving relative to the first shell so as to expose the crimping component;

wherein the socket comprises a pin that is connected to the jack of the plug and a second shell of a metal material; and multiple locking steel balls are set on the second shell, and the locking steel balls are located on a same section that is perpendicular to a side wall of the second shell; a locking sleeve is set on an external part of the first shell, an annular groove is set on an outer surface of the first shell, and a section in which the annular groove is located is perpendicular to the side wall of the first shell; wherein when the jack is connected to the pin, the locking sleeve on the first shell is pressed against the multiple locking steel balls on the second shell so that the multiple locking steel balls are engaged with the annular groove.

14. The power connector according to claim 13, wherein an elastic piece is further set in the second shell; wherein when the jack is connected to the pin, the first shell is tightly pressed against the elastic piece.

* * * * *